United States Patent [19]

Economopoulos et al.

[11] 4,161,800

[45] Jul. 24, 1979

[54] APPARATUS FOR IMPROVING THE QUALITY OF STEEL SECTIONS

[75] Inventors: Mario Economopoulos, Liege; Yves J. Respen, Herstal; Stephane H. Wilmotte, Liege, all of Belgium

[73] Assignee: Centre de Recherches Metallurgiques-Centrum voor Research in de Metallurgie, Brussels, Belgium

[21] Appl. No.: 834,327

[22] Filed: Sep. 19, 1977

Related U.S. Application Data

[62] Division of Ser. No. 619,022, Oct. 2, 1975, abandoned.

[30] Foreign Application Priority Data

Oct. 4, 1974 [BE] Belgium ..... 820750

[51] Int. Cl.[2] ..... C21D 9/54

[52] U.S. Cl. ..... 15/302; 134/64 R; 266/113; 266/114

[58] Field of Search ..... 266/111, 112, 113, 114; 148/146; 15/30 Z; 134/64 R

[56] References Cited

U.S. PATENT DOCUMENTS

| | | | |
|---|---|---|---|
| 3,659,428 | 5/1972 | Kunioka et al. | 266/113 X |
| 3,687,145 | 8/1972 | Schrader et al. | 266/113 X |

FOREIGN PATENT DOCUMENTS

| | | | |
|---|---|---|---|
| 412260 | 6/1974 | U.S.S.R. | 266/111 |

*Primary Examiner*—Roy Lake
*Assistant Examiner*—Paul A. Bell
*Attorney, Agent, or Firm*—Holman & Stern

[57] ABSTRACT

At the outlet of the finishing stand of a rolling mill, a cooling apparatus is arranged to surface quench only the outer layer of the flat face of a steel section by a cooling fluid. The cooling conditions are adjusted so that, at the outlet of the cooling zone, the unquenched parts of the section are at a temperature still sufficiently high to temper the quenched face, and so that the austenite is transformed into ferrite and carbides in the unquenched parts of the section.

1 Claim, 8 Drawing Figures

1
2
3
4
3
2
1
1
19
18
14
17
16
17
15
13
110
11
12

APPARATUS FOR IMPROVING THE QUALITY OF STEEL SECTIONS

This is a divisional of application Ser. No. 619,022, filed Oct. 2, 1975 now abandoned.

BACKGROUND OF THE INVENTION

The present invention relates to an apparatus for improving the quality of steel sections. The term "sections" should be understood as including, according to the present invention, I-beams, channels, angle irons, Tees, plates, large sheets, flat bars, and sheets, and generally any rolled section having at least one flat face.

The apparatus according to the invention may be employed to improve killed steels or semiskilled steels or rimming steels.

The main qualities required by the users in steel sections are, among others, as high as possible ultimate tensile stress, limit of elasticity, and impact strength for the grade of steel used, as well as satisfactory weldability, fatigue strength, and ductility for the intended use of the steel section.

To improve weldability and ductility of a steel it is necessary to decrease its carbon and manganese content, which in turn results in a decrease in its tensile strength. To remedy this inconvenience, the steel may be subjected to a suitable cooling process, preferably directly applied at the outlet of the rolling mill, which permits certain characteristics of the section to be improved to some extent.

Should such a cooling process result in an improvement deemed insufficient as far as properties of the sections are concerned, one may resort to other processes to complement the mere cooling action. Among such processes, reference should be made particularly to that which comprises adding dispersoidal elements (Nb, V) to refine the steel grains and to cause hardening of ferrite by precipitation of such elements. This procedure is surely effective but has the inconvenience of a cost which increases in proportion as one aims at a higher limit of elasticity; it is also the more expensive the larger the dimensions of the sections.

What is desired is a process which permits the abovementioned inconveniences to be avoided without increasing to an unacceptable extent the carbon and manganese contents in the steel of the sections concerned which would otherwise result in detrimental effects on their weldability and impact strength at low temperature.

SUMMARY OF THE INVENTION

According to the invention, at the outlet of the finishing stand of a section rolling mill, a suitable cooling apparatus is arranged to surface quench only the outer layer of a flat face (such as a flange) of the sections (the web of the channels being considered as a flange for this purpose) by means of a suitable cooling fluid. The conditions of such cooling are adjusted so that, at the outlet of the cooling zone produced by the fluid, the non-quenched parts of the sections are at a temperature still high enough to make it possible to cause a tempering of the quenched surface layer owing to the heat in the non-quenched part, and that it is possible to transform austenite into ferrite and carbides in the non-quenched parts of the sections.

Depending upon the operating conditions for carrying out the process, the surface layer due to the section quenching comprises tempered martensite or bainite.

The cooling fluid is preferably water, possibly an aqueous suspension or solution of mineral salts and/or surfactants, for example sprayed onto the section by means of a conventional sprayer, or in the form of a supersonic mist (a suspension of a liquid in a gas, such as water in air or steam) or a laminar jet (such as by means of a flat-front laminar nozzle). The cooling fluid may also simply be a gas projected at supersonic speed.

From the practical point of view, a section can be cooled to the desired extent by suitably choosing the cooling apparatuses such as cooling sprayers and by suitably adjusting the length and the relative position of such apparatuses.

The process permits sections of a special type to be obtained, such sections having at least one flat face whose outer layer is bainitic or comprises tempered martensite and the other parts consist of ferrite and carbides.

According to an advantageous modification of the process, it is possible, during the surface quenching operation, to control the temperature increase of the product by maintaining the heat exchange between the fluid and the product in substantially optimum conditions. This modification is characterized in that the intense surface cooling operation of the product is performed in at least two steps separated by a stage during which temperature homogenization takes place at least at the skin of the product.

According to such modification, the product is intensely cooled in several successive stages of short duration separated by periods of temperature homogenization for the product skin, at least the last cooling stage ensuring the martensitic and/or bainitic quenching of the rolled product.

According to one way of carrying out the process, one determines the number and the conditions for carrying out the various cooling and temperature homogenization stages for the product to ensure optimum removal of heat from the product. According to this way of carrying out the process, the optimum conditions for removing heat are determined by means of a diagram indicating the variation of the heat flow as a function of the temperature at the surface of the processed product.

In practice, in a first heavy cooling stage, the temperature at the surface of the rolled product is lowered to a level slightly lower than the temperature corresponding to the maximum value of heat flow; cooling is stopped for a short interval which results in a temperature increase at the skin owing to the effect of heat being supplied from the core; a new cooling stage is started when the temperature at the surface attains a level slightly higher than the temperature corresponding to the maximum value of heat flow.

The application of the various successive stages or steps then results in maintaining the skin temperature within limits corresponding to heat exchange conditions close to the optimum ones.

Owing to the optimum conditions ensured by the process, surface quenching of the rolled product is performed with minimum consumption of water and/or by means of a shorter installation.

The process may be easily and advantageously employed for the manufacture of rails for railways. In such an application, at the outlet of the finishing stand of a rail rolling mill, the upper part of the rail flange is subjected to surface quenching by means of a suitable cooling fluid, and the conditions of cooling are adjusted so that, at the outlet of the zone of cooling by the fluid, the unquenched part of the flange is at a sufficient temperature to permit, while the rail is on the cooler, the quenched surface layer consisting then of martensite or bainite to be tempered and the austenite to be transformed into ferrite and carbides in the unquenched part.

A steel section having a composite structure is obtained by means of the above-described process.

As mentioned above, it is well known that one obtains sections whose properties have been improved substantially owing to grain refining obtained through suitable heat treatments or by adding elements such as niobium, for example. A steel section having such fine grains combines a good ductility with a satisfactory limit of elasticity.

In view of the process when applied to such sections, a steel is obtained whose most complex structure gives a section both mechanical characteristics considerably improved with respect to those of the above-mentioned sections and, the mechanical characteristics being equal, a particularly economic character, this economy being due for example to the fact that such characteristics are obtained with lower alloy-element contents, or by using a semikilled steel rather than a killed one.

The steel section has a structure, in a cross section taken in a plane normal to its axis, having at least two zones substantially parallel to the surface of the flat element forming the section, one of these zones comprising tempered martensite and untempered bainite and the other of these zones comprising untempered bainite and untempered ferrite-pearlite.

The section may comprise an intermediate zone between the two zones, the intermediate zone substantially consisting of untempered bainite.

According to an advantageous modification of the structure of the above-defined section, the zone comprising tempered martensite and untempered bainite is also covered, on the side thereof opposite to the zone comprising untempered bainite and ferrite-pearlite, by a zone mainly consisting of pure tempered martensite.

According to another advantageous modification of such structure, the zone comprising untempered bainite and ferrite-pearlite is adjacent to a layer mainly consisting of untempered ferrite-pearlite, on the side thereof opposite to the zone comprising untempered bainite and tempered martensite.

Of course, when cooling is applied to the two faces of a flat product or a section comprising flat parts, it should be understood that the configuration of the various zones forming the structure of the flat section generally follows the configuration of the product or the section itself.

BRIEF DESCRIPTION OF THE DRAWINGS

The invention will be described further, by way of example only, with reference to the accompanying drawings, in which.

DETAILED DESCRIPTION OF PREFERRED EMBODIMENTS

Figures 1, 2:
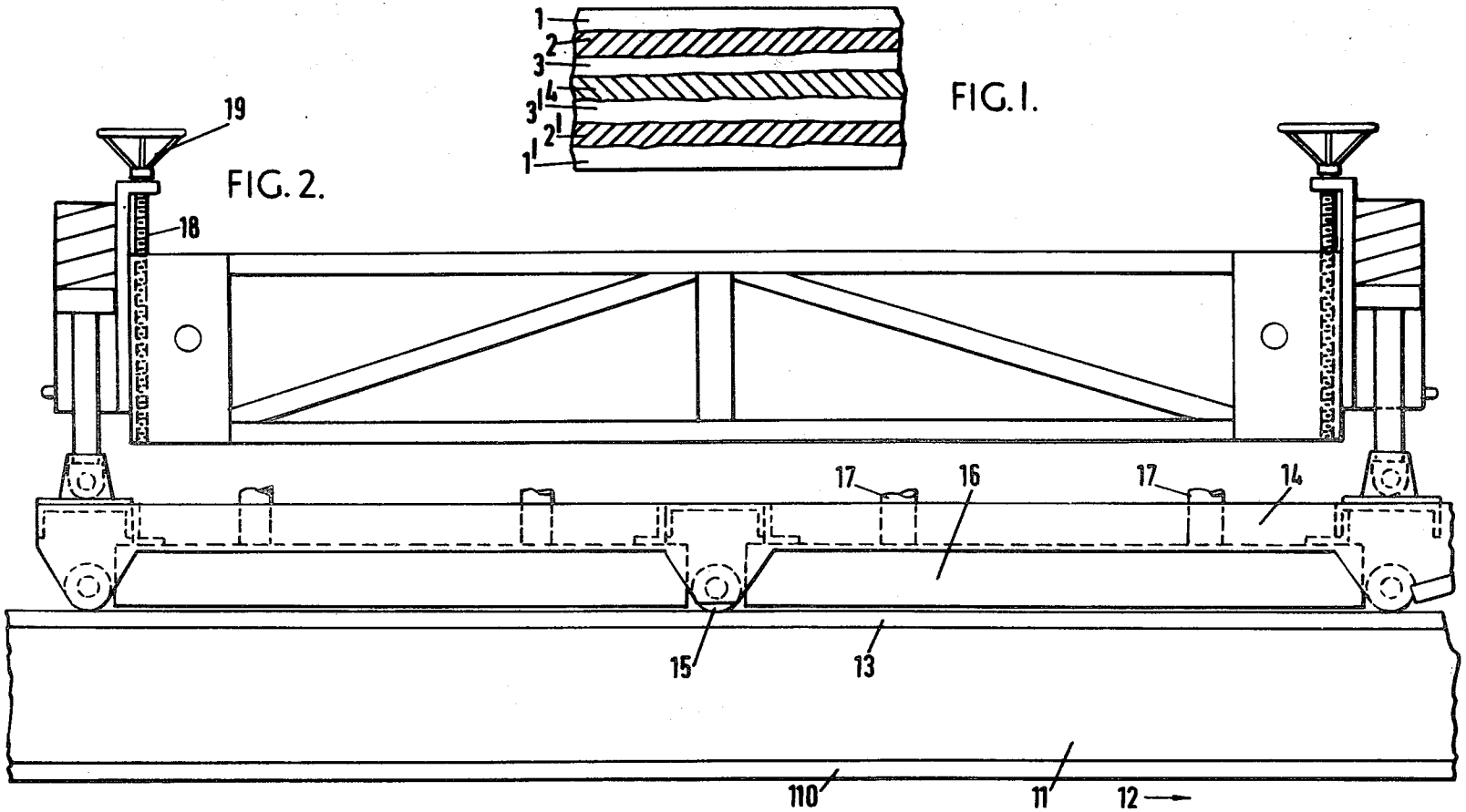
FIG. 1 is a cross section through part of a flat section.
FIG. 2 is a side elevation view of apparatus for cooling a beam.

FIG. 1 shows a portion of the cross section of one type of flat section which was quenched at its two faces. The section has zones 1 and 1' mainly comprising pure tempered martensite, zones 2 and 2' comprising tempered martensite and untempered bainite, zones 3 and 3' comprising untempered bainite and untempered ferrite-pearlite, and a zone 4 mainly comprising untempered ferrite-pearlite.

From a practical point of view, the desired cooling of the section is obtained by suitably choosing the cooling devices such as cooling sprayers and by suitably adjusting the length and the relative position of these devices.

The apparatus for processing sections may comprise a container forming a reservoir for the cooling fluid and having fluid feeding means, a wall of the container being a perforated wall which has orifices arranged to atomize the cooling fluid onto the surface of the section which is conveyed past the perforated wall.

When the flat section such as a hot-rolled sheet has to be cooled at its two faces, it is advantageous to combine two apparatuses according to the invention, the atomized jets of such apparatuses being opposite to each other, and to displace the section through the tunnel thus formed.

According to a constructive embodiment of the apparatus of the invention, the perforated wall has, transversely to the direction of movement of the product, a dimension at least equal to the width of the part to be treated.

When, step by step quenching is planned for a given section, use is made of an installation of the type described above but having at least two cooling apparatuses arranged in series and separated by a re-heating zone for the product skin.

Particularly in such a case, the cooling apparatuses used advantageously have a high heat transfer coefficient, such apparatuses preferably having means for adjusting the cooling fluid flow.

In a particular embodiment of the installation according to such modification, at least one of the re-heating zones of the section skin has a device such as a hood to decrease the heat removal rate.

In another embodiment of the installation, at least one of the cooling zones for the section skin has a device arranged to heat the product.

Figure 4:
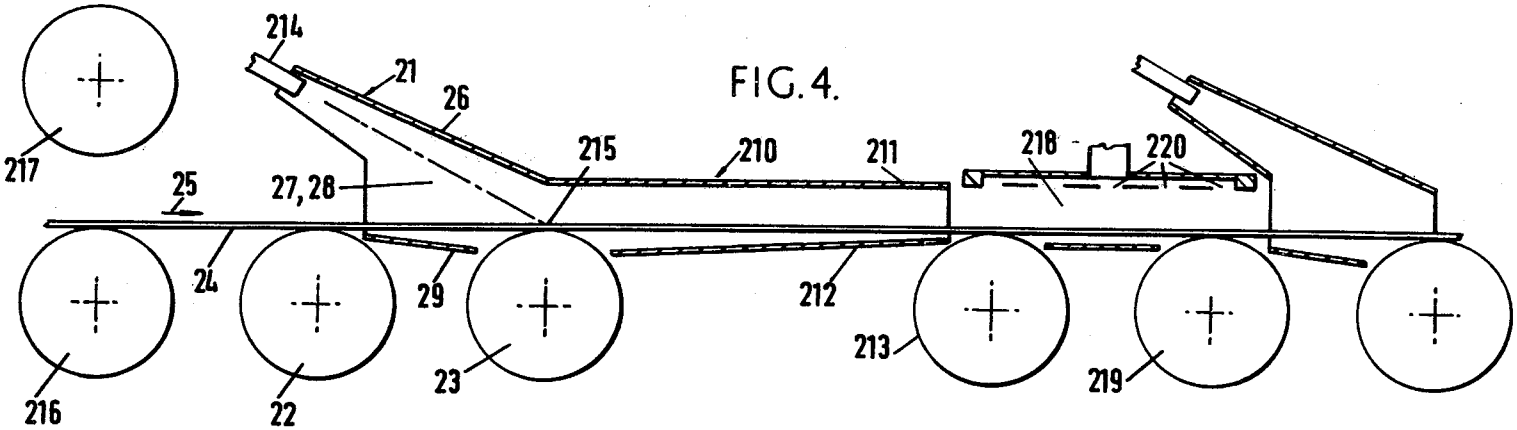
FIG. 4 is a side elevation view of apparatus for cooling a flat product.
Figure 3:
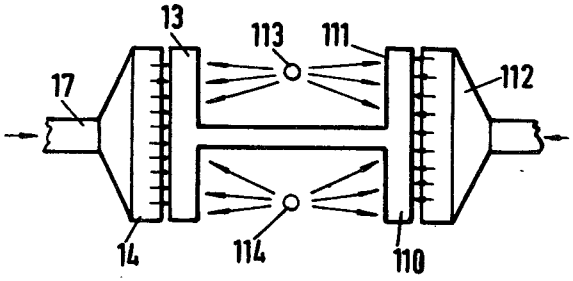
FIG. 3 is a cross section of the apparatus of FIG. 2.
Figure 5:
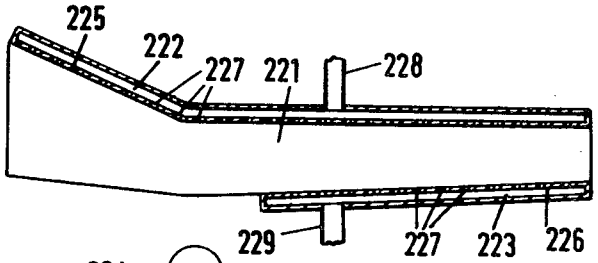
FIG. 5 is a side elevation view of part of a similar apparatus for cooling a flat product.

The accompanying drawings show an apparatus arranged to cool a beam (FIGS. 2 and 3) and a flat product while being rolled (FIGS. 4 and 5).

FIG. 2 shows a section 11 (to be cooled Grey beam) while being rolled in the direction of the arrow 12. A carriage 14 is carried on the upper flange 13 of the beam 11 through rollers 15.

The carriage 14 is maintained in position by an abutment (not shown) and the carrying rollers 15 rotate while the beam 11 is displaced. The carriage 14 has cooling fluid containers 16 supplied with cooling fluid via conduits 17. The position of the containers 16 is adjusted with respect to the beam 11 by means of screws 18 and hand wheels 19. The connection between the screws 18 and the containers 16 is not shown, for simplicity of the drawings.

A similar apparatus, i.e. a container 112, is located under the lower flange 110 of the section 11, while the inner parts 111 of the flanges are under lateral jets, on the two sides, by means of suitable sprayers 113 and 114 (see FIG. 3) which spray air and water.

According to the invention, apparatuses different from the cooling fluid orifices outside the containers 16 or 112 may be employed such as in the form of a transverse slot or a pattern of small diameter orifices.

The example given below permits the quality improvement of the sections obtained by employing the apparatus of the invention to be appreciated. The section examined is a Grey beam DIN 40 of an aluminum and silicon killed steel containing 0.165% C. and 1.32% Mn. This beam leaves the rolling mill rough-rolled at a temperature of from 800° C. to 850° C. and has the following characteristics without applying employing the process apparatus of the invention:

limit of elasticity: 38 kgf/mm$^2$
ultimate tensile stress: 55 kgf/mm$^2$
impact strength: 5 kgf m/cm$^2$ at −20° C.

The same beam leaving the rolling mill at the same temperature conditions has the following characteristics after employing the apparatus of the invention (intense surface-cooling) for 10 seconds:

limit of elasticity: 45 kgf/mm$^2$
ultimate tensile stress: 60 kgf/mm$^2$
impact strength: 9.0 kgf m/cm$^2$ at −20° C.

These characteristics were obtained by means of a cooling apparatus operating under the following operating conditions:

rolling speed: 1 m/s
cooling time: 10 s
length of the cooling sprayer 10 m
water enclosures (containers 16 and 112) formed of elements of 100 mm in the rolling direction.
Distance with respect to the section: 3 to 6 mm
Water pressure: 1 to 3 kg/cm$^2$
Water flow: 15 to 50 m$^3$/h
sprayers: convergent—divergent
diameter of the neck: one mm
air pressure: 4 kg/cm$^2$
air flow: 1.5 to 2.5 Nm$^3$/h
water pressure: 3 to 4 kg/cm$^2$
water flow: 5 el/min
distance with respect to the web of the section: 100 mm
distance between sprayers: 100 mm
temperatures: at the inlet: below the $Ac_3$ point at the outlet: from 600° C. to 700° C. (between 10 and 20 seconds after leaving the cooling sprayers).

Figure 6:
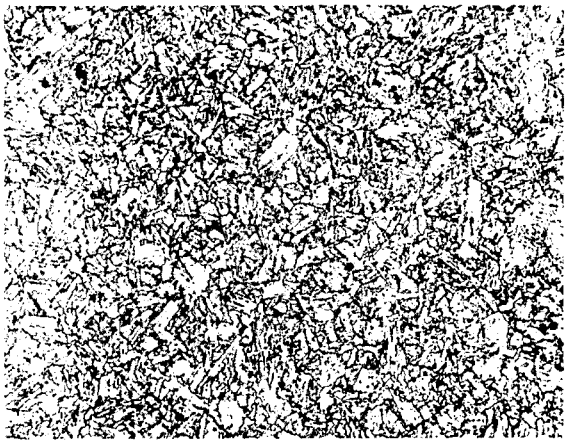
FIGS. 6 to 8 are photomicrographs of steel sections.
Figure 7:
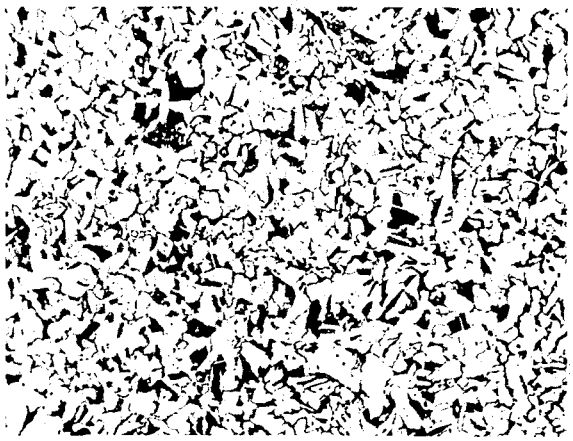
Figure 8:
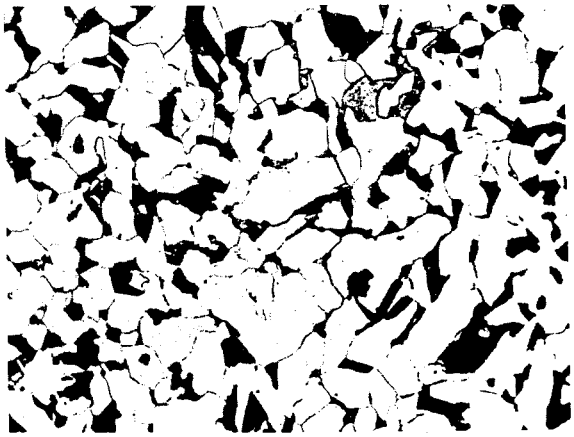

The photomicrographs of FIGS. 6 and 7 show various structures of a flange of a Grey beam DIN 40 treated in accordance with the invention: FIG. 6 shows the skin structure of such a flange (tempered martensite and/or bainite); FIG. 7 shows the structure at 7.5 mm from the skin of the external face of such flange (ferrite+carbide structure). FIG. 8 shows the structure of the same flange not being treated according to the invention. The structure comprises ferrites and carbides with coarser grains since the cooling speed is slower.

Within the scope of the above described apparatuses, in order to considerably increase the cooling power of the used fluids, it is advantageous to apply them in a laminar configuration. Such apparatus, for example using water, comprises at least one baffle portion whose configuration causes the cooling liquid successively to change direction several times, the total length of the baffle and the dimensions of the fluid passage being such that the flow of the cooling liquid throughout the apparatus is laminar.

In a constructional embodiment of the invention, more specifically adapted to the treatment of flat sections such as sheets, a series of sprayers of the above-described type with their outlet slits for the cooling liquid parallel to each other is arranged substantially in the same plane.

In a particular modification of such apparatus according to the invention, the straight length preceeding the outlet slit comprises an element such as a corrugated element, arranged in the direction of the liquid flow to better ensure a laminar flow of the jet.

FIG. 4 shows a modification of the apparatus according to the invention, particularly suitable for ensuring quick and controlled cooling of flat rolled products at the outlet of the finishing rollers.

According to this embodiment, the apparatus comprises in succession:

(a) a cooling water case, possibly with a double wall,
(b) a drying air case, and
(c) another cooling case of the type referred to under (a) or the like, and one or more cooling water cases of the double-wall type but arranged to be located between two successive rollers at a standard distance from one another.

A cooling case 21 of the type referred to under (a) and illustrated in FIG. 4 is associated with a certain number of transport rollers 22, 23, lower rollers designed to carry and to convey a strip or sheet 24 to be cooled, the sheet being displaced in the direction of the arrow 25.

The cooling case 21 comprises two successive parts, the first of which is an inlet container 26 having a roof downwardly inclined in the direction of movement of the sheet, two side walls 27 and 28 located at the ends of the rollers 22 and 23, a lower wall 29 located below the sheet 24 and leaving little space between itself and the rollers 22 and 23, while being slightly inclined downwards in the direction indicated by the arrow 25. The second of the successive parts of the case 21 comprises a container 210 lower in height than the inlet of the container 26 and has a substantially horizontal roof 211, and a bottom wall 212 located at a short distance from the two adjacent rollers 23 and 213 and slightly inclined in a direction opposite to that indicated by the arrow 25.

The cooling case 21 has a device 214 located at the upper part of the inlet of the roof of the container 26 and arranged to eject one or more water jets inside the container in the direction of the roller 23 so as to impinge upon the upper surface of the sheet 24 in a zone 215 directly above the axis of the roller 23. A pair of rollers 216 and 217 is advantageously located before the container 26, the roller 216 being a carrying roller and being located at the usual level under the sheet 24, the second roller 217 being displaced upwards to correctly guide the sheet 24 towards the inlet of the container 26, independently of the surface irregularities of the sheet even at its end. The excess of water is discharged from this container past the roller 23.

The cooling case just described has the following advantages:

1. The water ejected by the device 214 is guided along the rolled sheet 24 owing to the limited space between the roof 211 of the container and the sheet 24.
2. Possibility of accepting without difficulty sheets having surface irregularities.
3. Possibility of acting on the water distribution depending on the width of the sheet by selecting one or more water jets.

4. Possibility of displacing the sheet by directing the water jets onto the sheet at the zone where it rests on the roller 23. The sheet is thus urged into the container 210. In practice, the water flow to such container is high (of the order of 1000 $m^3/h$) under a relatively low pressure (about 1 $kg/cm^2$). With these data, heat transfer coefficients of the order of 0.1 $cal/cm^2$. s °C. are frequently attained.

The drying air case referred to under (b) and indicated as 218 in FIG. 4 is associated with at least two rollers 213 and 219 carrying the sheet 24 while it moves through the case 218. The height of the passage cross section of this case is sufficient to allow the sheet to go through, account being taken of the fact that the sheet may have surface irregularities which might result in relatively large dimensions.

The roof of the case 218 has a number of orifices 220 through which a large amount of dry gas such as air can be blown under low pressure so as to form an air cushion between the wall and the sheet and to define a barrier for the water covering the sheet at the outlet of the container 210. This operation has the advantage that the subsequent cooling step can thus be carried out on a dry sheet, which considerably increases its efficiency.

A cooling water case 221 of the double-wall type such as indicated in FIG. 5, has in principle the same general configuration as the case 21, except that its upper part 222 and its lower part 223 following the roller 224 are both doubled by a wall 225 and 226 having orifices 227 through which water is ejected against the sheet, these orifices being fed with water via conduits 228 and 229. This arrangement permits a better distribution of the water on the sheet and a practically symmetrical cooling thereof to be obtained.

According to the invention, in the case where not much room is available for locating the above described apparatuses, it is advantageously possible to use a succession of cooling apparatuses of the double-wall case type, for example arranged from above downwards between the carrying rollers arranged at a standard distance from each other. Each of these apparatuses comprises a double-wall container within which the sheet to be cooled is displaced. Such containers have two openings, an upper opening and a lower opening, for feeding a cooling liquid inside the container the inner walls of which have orifices arranged to eject liquid onto the two faces of the sheet.

This device, particularly adapted to the treatment of a metal sheet while being rolled and heavily cooled, comprises, arranged one after the other, at least:

(a) a case (called the inlet case) comprising means for water-cooling the sheet and (b) a case (called an air drying case) comprising means for removing from the sheet the water applied to it while going through the inlet case.

According to an interesting modification of this apparatus, it further comprises at least one double-wall container arranged to water cool the sheet at the outlet of the drying case, and a member arranged to dry the sheet at the outlet of the double-wall container.

The inlet case advantageously comprises a container having two distinct parts, the first of which, on the inlet side of the sheet, has a height decreasing down to right above the upper generatrix of a roller, the upper part of this roller being located inside the case, owing to the presence of an opening formed in the bottom wall of the case, the roof of the second part being substantially horizontal with respect to the plane taken as a reference plane for the sheet going through the case, the bottom walls of the two parts of the case, one being arranged before the roller and the other after it, are slightly inclined towards the roller without touching it; moreover, on the inlet side of the sheet, the case has a device arranged to eject water onto the upper part of the sheet substantially in the direction of the zone where the sheet, assumed to be plane, contacts the roller, the roller carrying the sheet and conveying it towards the outlet of the case.

The drying case comprises, according to a preferred embodiment, a container which is open at its ends to permit the passage therethrough of the sheet to be treated, the roof of the container being substantially parallel to the plane of the sheet and being double-walled, the outer wall having an orifice for connection to a pressurized air supplying installation, the inner wall having a number of orifices along most of its length arranged to permit air to be blown onto the sheet, the bottom wall of the container having at least one recess arranged to allow the upper part of a sheet carrying and conveying rollers to be introduced into the container.

The double-wall container for feeding water advantageously comprises an elongated case in the direction of movement of the sheet, the case being open at its two ends and comprising two distinct parts, the first of which, on the inlet side, has a height decreasing approximately to right above the upper generatrix of a roller, the upper part of this roller being located inside the case owing to the presence of an opening formed in the bottom wall of the case, the roof of the second part being substantially horizontal with respect to the plane taken as a reference plane for the sheet passing through the case, in that the bottom walls of two parts of the case, one of which is located before the roller and the other after it, are slightly inclined towards the roller without contacting it, the roofs of the two parts as well as the bottom wall of the second part having a double-wall the outer element of which has an opening for the connection to a water supply device, whereas the inner element has a series of orifices arranged to eject water onto the two faces of the sheet.

According to another interesting embodiment of the double wall container, being designed to be arranged vertically above the space between two successively rolling rollers, the container comprises a simple parallelepipedic case, with neither an inlet nor an outlet wall, in the direction of movement of the sheet, the roof and the bottom wall of the case being double-walled, the outer walls thereof having an opening for the connection to a water supply device, whereas the inner walls have a series of orifices arranged to permit the ejection of water onto the two faces of the sheet.

The member which is arranged to dry the sheet at the outlet of the double-wall container advantageously comprises a duct the outlet section of which is in the form of a narrow horizontal slit and its orientation is such that the plane air jet from it impinges the wetted sheet at a very small angle, so as to permit an easy adjustment of the water flow on the upper face of the sheet; the water ejected against the lower face of the sheet being eliminated owing to the pressure exerted against this face by the roller on which the sheet is displaced.

We claim:

1. An apparatus for improving the quality of a steel section at the outlet of a section rolling mill, the apparatus comprising: a container forming a reservoir of a cooling fluid and having one wall perforated by orifices for atomizing and directing the cooling fluid onto a flat surface of a rolled section being displaced past the perforated wall; and means for supplying the cooling fluid connected to the container; said container comprising, arranged one after the other:

(a) a first enclosure comprising means for water-cooling the rolled sections, and (b) an air-drying enclosure comprising means for removing from the section water applied to it while passing through the first enclosure;

said first enclosure comprising a case having two distinct portions, a first portion on the inlet side of the section, said first position having a height decreasing down to a root of said case which is directly above the upper generatrix of a roller, the upper part of this roller being located inside the case owing to the presence of an opening in its bottom wall, a second portion having a roof substantially horizontal with respect to the plane taken taken as a reference plane for the section going through the case, the bottom walls of the two portions of the case, one being arranged before the roller and the other after the roller, being slightly inclined towards the roller without touching it; and on the inlet side of the section said means for water cooling comprises a device arranged to eject water onto the upper part of the section substantially in the direction of the zone where the section, assumed to be plane, contacts the roller, the roller carrying the section and conveying the section towards the outlet of the container.

* * * * *